US005099933A

United States Patent [19]

Schimke et al.

[11] Patent Number: 5,099,933

[45] Date of Patent: Mar. 31, 1992

[54] DRILL BIT FOR DRILLING ALONG ARCUATE PATH

[75] Inventors: Thomas O. Schimke; Wilfred M. McCord, Jr., both of Louisville, Ky.

[73] Assignee: Vermont American Corporation, Louisville, Ky.

[21] Appl. No.: 406,764

[22] Filed: Sep. 13, 1989 (Under 37 CFR 1.47)

[51] Int. Cl.[5] ..... E21B 10/26

[52] U.S. Cl. ..... 175/385; 144/106; 408/55; 408/216

[58] Field of Search ..... D15/138, 139, 140; 408/23, 46, 81, 88, 89, 90, 191, 193, 213, 214, 215, 216, 227, 1, 54, 55; 144/10 F, 108, 28.3, 1 E, 1 F, 35 R, 35 A, 93 R, 96, 106, 228, 69, 70, 82, 83, 67, 220, 167; 175/385

[56] References Cited

U.S. PATENT DOCUMENTS 2,689,131 3/1952 Priest ..... D15/140

FOREIGN PATENT DOCUMENTS 181841 5/1986 European Pat. Off. ..... D15/140

563234 11/1971 U.S.S.R. ..... 408/228

*Primary Examiner*—Ramon S. Britts

*Assistant Examiner*—Roger J. Schoeppel

*Attorney, Agent, or Firm*—Middleton & Reutlinger

[57] ABSTRACT

A drill bit for drilling holes around the corner of a workpiece is provided with a single rounded continuous cutting edge with radiused upper and lower corners to permit free rotation of the cutting head as it is urged along an arcuate path The bit is of a unique two piece construction permitting selective materials to be utilized in the shank an cutting head portions.

5 Claims, 1 Drawing Sheet

DRILL BIT FOR DRILLING ALONG ARCUATE PATH

BACKGROUND OF THE INVENTION

The present invention relates to drill bits and, in particular, to a drill bit which can drill along an arcuate path.

There are many situations in the building industry which require holes to be drilled through two perpendicular faces of a board to form a continuous path. This is particularly useful for installing electric wiring which needs to be fed from an inside wall up into an attic, and so forth.

Until now, the way a builder would handle such a situation is that a straight hole would be drilled in from each face and, hopefully, the two holes would intersect. This requires very precise drilling and measurement. If one hole extends beyond the intersection, the wire will tend to go down that extension and get stuck. Even if a perfect L-shaped hole is formed, the wire may get stuck, since there is nothing to urge it along a gradual bending path.

There is a drill bit in Europe, as described in European Patent Publication EP 0181841, which can start at one face and cut along an arcuate path until it comes out through a perpendicular face. This comes closer to meeting the needs of the builder. However, there are several problems with this bit. The first is that it is very complicated, with several cutting edges, each requiring a separate grinding operation—about about 15 grinding operations in all. This makes the bit extremely expensive to manufacture, which is probably why it has not yet made its way to the United States. In addition, this bit cuts a very jagged-edged hole, providing numerous places for wires to get caught.

SUMMARY OF THE INVENTION

The present invention overcomes many of the problems found in the prior art.

First, the drill bit of the present invention is provided with a single continuous cutting edge, with special radii at the top and bottom of the cutting edge, which permits the bit to cut smoothly along an arcuate path without creating jagged sides to the hole, so the resulting hole is ideal for receiving electrical cables.

Second, the drill bit of the present invention is much simpler to manufacture than the prior art bit. Its single continuous cutting edge requires far fewer grinding operations and, as a result, it can be made to sell for approximately one-tenth the cost of the prior art bit. This is a very substantial difference in cost which permits the present invention to be widely available in the market.

In addition, by equipping the present invention with radiused spurs at the top and bottom of the cutting edge, the sharp projections of the prior art bit are eliminated, with the result that the bit of the present invention will be able to cut much longer without wearing out.

The bit of the present invention is also made in a unique two-piece construction, with the cutting head and the shaft made separately. This means that each piece can be made with the optimum material characteristics. The shaft can be heat-treated to increase toughness to withstand the bending stresses without affecting the hardness and edge retention properties of the cutting head. This is a considerable improvement over the prior art, in which the shaft and head are made as one piece and therefore must both be a compromise between the ideal properties of a shaft and the ideal properties of a cutting head. This two-piece construction also reduces the cost of manufacture from the prior art.

The bit of the present invention is also easier to handle than the prior art bit. With its continuous rounded cutting edges, the bit of the present invention is not as aggressive as the prior art bit and therefore can be controlled more easily.

DETAILED DESCRIPTION OF THE PREFERRED EMBODIMENTS

Figure 3:
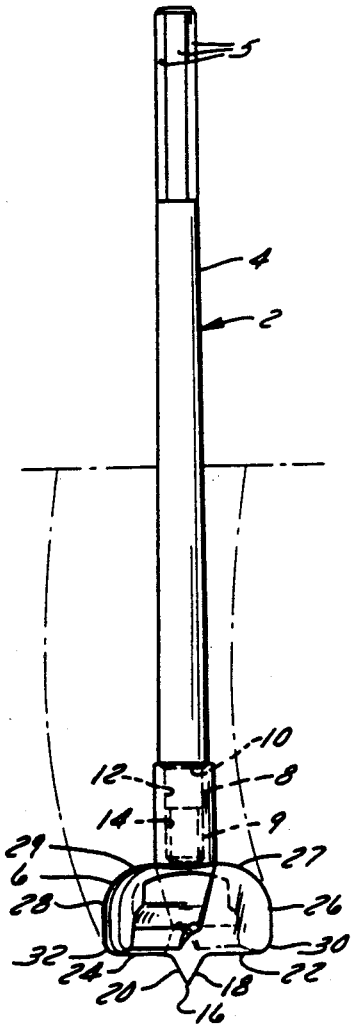
FIG. 3 is an enlarged front view of the bit of the present invention.
Figure 4:
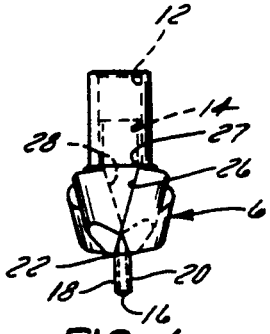
FIG. 4 is a side view of the bit of FIG. 3.
Figure 5:
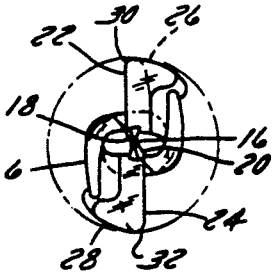
FIG. 5 is an end view of the bit of FIG. 4 with the hole shown in phantom.
Figure 6:
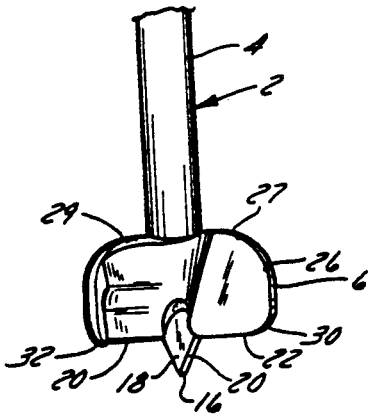
FIG. 6 is an alternate embodiment of the invention, with the cutting head 6 and shaft 4 made as one piece.

As shown best in FIG. 3, the bit 2 of the present invention is made in two pieces, including an elongated shaft 4 and a cutting head 6. The shaft 4 has hexagonal flats 5 on one end to permit it to be received in a drill chuck. At its other end 8, the shaft 4 has a reduced diameter and includes male threads 9 in its outer surface. A shoulder 10 is formed where the diameter of the shaft 4 is reduced.

The cutting head 6 has an axial opening 12 which defines female threads 14 cn its inner surface. The threads 14 of the cutting head are received by the threads 9 of the shaft 4 to join the shaft and head together. The inside diameter of the opening 12 of the cutting head is less than the diameter of the shoulder 10 on the shaft, so the shoulder 10 serves as a stop for the head as it is threaded onto the shaft 4.

The bit 2 is provided with threads 9, 14 which facilitate assembly of the head 6 onto the shaft 4. Also, as the bit 2 is being assembled, an adhesive is applied to the mating threaded surfaces 9, 14 so that, when the adhesive sets, a solid bond is made between the two pieces. The adhesive that has been used for this purpose is Loctite brand permanent grade adhesive.

As was mentioned earlier, one of the advantages of making the bit 2 in two pieces is that the head 6 and shaft 4 can be made of different materials or can be subjected to different treatments before assembly so that each part has the ideal properties to perform its function. The shaft should be tough to resist fatigue which can lead to snapping, cracking or breaking as the shank is stressed while being urged or forced along the arcuate path during cutting. The cutting head should be hard and resist abrasion for good cutting and edge retention. If the bit 2 is made as a single piece, the material properties of the bit will be a compromise between these characteristics. For example, with the present invention, the shaft 4 is preferably made of carbon steel and is heat treated to improve toughness, while the head 6 is preferably made of tool steel. The result is that the Rockwell hardness of the shank is about 48–50 on the C-scale, while the hardness of the head is about 58–60.

Now, looking at the cutting head 6 in more detail, as shown in FIGS. 3–6), the cutting head 6 defines a central, forward projecting point 16 which is substantially flat and defines cutting edges 18, 20 on both sides. The main body of The cutting head 6 defines two forward cutting edges 22, 24 and two, and two rear cutting edges 27, 29 which extend back toward the shank. The cutting edge 18, 20 on the sides of the point 16 meet with their respective forward cutting edges 22, 24, which, in turn, meet with their respective side which meet with their respective rear cutting edges 27, 29 so that a single continuous cutting edge is formed on each side of the cutting head 6—one cutting edge including the side 18 of the point 16, the forward cutting edge 22, and the side cutting edge 26 and the rear cutting edge 27, and the cutting edge on the other side including the point edge 20, forward edge 24, and side edge 28 and rear edge 29.

The intersections 30, 32 between the forward cutting edges 22, 24 and their respective side cutting edges 26, 28 are rounded. The side cutting edges 26, 28 have their maximum diameter where they meet their respective rounded corners 30, 32. The junction between the side cutting edges 26, 28 and their respective rear cutting edges 27, 29 is also rounded, forming a continuous, smooth cutting edge from the point 16 to the shank. The side cutting edges 26, 28 define a smooth, curved line, and the rounded shape of the back of the cutting head 6 enables it to continue to freely rotate during cutting as it follows the arcuate path of the hole without the back cutting edges binding on the sides of the hole. The rear cutting edges 27, 29 also prevent the bit from binding when backing out of the hole, because they also cut a path. No portion of the cutting head has a greater diameter than the side cutting edges 26, 28 at any point along the cutting head.

Figure 1:
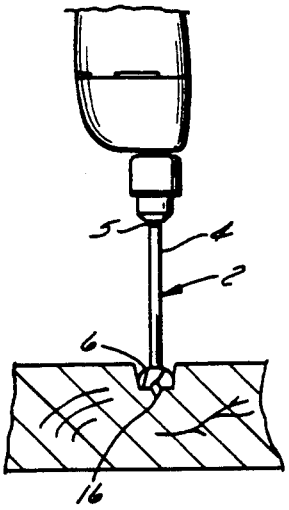
FIG. 1 is a front view of the bit of the present invention drilling into a wood substrate.
Figure 2:
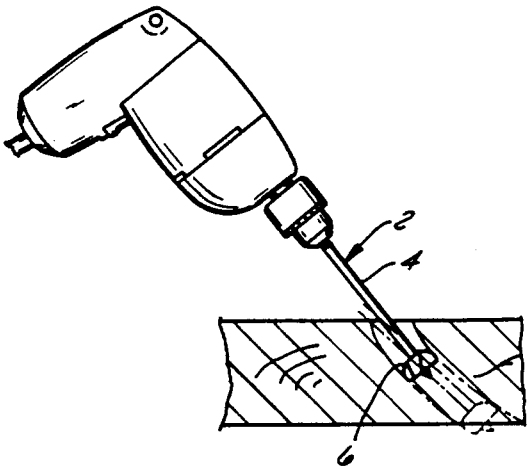
FIG. 2 is a perspective view of the bit of FIG. 1 drilling further along the arcuate path.

FIGS. 1 and 2 indicate how the bit 2 is used. As shown in FIG. 1, the bit initially drills straight into the face of the workpiece. Then, once the cutting head 6 is in the workpiece, the person handling the drill begins to apply a side force to the bit in addition to the downward force to urge it along an arcuate path. This force causes bending stresses in the shaft 4, which can be withstood by the bit of the present invention due to its two-piece construction which permits the shaft 4 to be made of a tougher material than the head 6.

The point 16 and its cutting edges 18, 20 keep the bit centered. The forward cutting edges 22, 24 cut material directly ahead of the bit, and the side cutting edges 26, 28 cut the sides of the hole. The bit 2 follows an arcuate path as is shown in FIG. 2, until it comes out at a side face of the workpiece (not shown). The result is an arcuate hole through which wires can be inserted without getting caught on the sides of the hole.

It will be obvious to those skilled in the art that modifications may be made to the embodiment described above without departing from the scope of the present invention.

What is claimed is:

1. A drill bit for drilling along an arcuate path, comprising:

a shank; and a cutting head, defining a. a forward-projecting central point; and b. a forward cutting edge; a side cutting edge; and a rear cutting edge; wherein the forward cutting edge and side cutting edge intersect at a rounded corner, and the side cutting edge and rear cutting edge intersect at a rounded corner to form a single, continuous cutting edge.

2. A drill bit for drilling along an arcuate path, as recited in claim 1, wherein the side cutting edge has its maximum diameter approximately where it meets the forward cutting edge.

3. A drill bit for drilling along an arcuate path, as recited in claim 2, wherein said cutting head defines two of said forward cutting edges, two of said side cutting edges, and two of said rear cutting edges.

4. A drill bit for drilling along an arcuate path as recited in claim 3, wherein the cutting head and the shank are two separate pieces, with the cutting head being made of a harder material than the shank for superior cutting characteristics.

5. A drill bit for drilling along an arcuate path as recited in claim 4, wherein the shank is made of a tougher material than the cutting head to withstand bending stresses.

* * * * *

UNITED STATES PATENT AND TRADEMARK OFFICE

CERTIFICATE OF CORRECTION

PATENT NO. : 5,099,933

DATED : March 31, 1992

INVENTOR(S) : Thomas O. Schimke and Wilfred M. McCord, Jr.

It is certified that error appears in the above-identified patent and that said Letters Patent is hereby corrected as shown below:

Column 3, line 5, delete "The" and insert --the--;

Column 3, line 6, after "edges 22,24 and two" and before ",and two rear cutting edges" insert --side cutting edges 26,28--;

Column 3, line 10, after "their respective side" and before "which meet with their" insert --cutting edges 26,28--;

Column 3, line 26, after "to the shank" and before "The side cutting edges" insert --4. --.

Signed and Sealed this

Seventh Day of December, 1993

Bruce Lehman

*Attest:*

BRUCE LEHMAN

*Attesting Officer*

*Commissioner of Patents and Trademarks*